US010010163B2

(12) United States Patent
Wells

(10) Patent No.: US 10,010,163 B2
(45) Date of Patent: Jul. 3, 2018

(54) WEARABLE SURVIVAL SLING

(71) Applicant: Brandon Wells, Casselberry, FL (US)

(72) Inventor: Brandon Wells, Casselberry, FL (US)

(73) Assignee: Brandon Wells, Casselberry, FL (US)

( * ) Notice: Subject to any disclaimer, the term of this patent is extended or adjusted under 35 U.S.C. 154(b) by 0 days.

(21) Appl. No.: 15/609,727

(22) Filed: May 31, 2017

(65) Prior Publication Data

US 2017/0340094 A1 Nov. 30, 2017

Related U.S. Application Data

(60) Provisional application No. 62/343,560, filed on May 31, 2016.

(51) Int. Cl.

| | |
|---|---|
| ***A45F 5/00*** | (2006.01) |
| ***A45F 3/00*** | (2006.01) |
| ***A41F 9/00*** | (2006.01) |
| *A45F 3/02* | (2006.01) |

(52) U.S. Cl.

CPC ..... *A45F 5/00* (2013.01); *A41F 9/002* (2013.01); *A45F 3/005* (2013.01); *A45F 3/02* (2013.01); *A45F 2005/002* (2013.01); *A45F 2200/0575* (2013.01)

(58) Field of Classification Search

CPC ..... A44C 5/0007; A45F 2005/008; A45F 2200/0575; A45F 2003/142; A45F 3/02; A45F 3/005

See application file for complete search history.

(56) References Cited

U.S. PATENT DOCUMENTS

| | | | | |
|---|---|---|---|---|
| 8,925,348 | B2 * | 1/2015 | Gagne | A44C 5/0007 63/1.12 |
| 9,021,664 | B2 * | 5/2015 | Ingalls | F16G 11/00 24/115 R |
| 9,084,455 | B2 * | 7/2015 | Millan | B26B 9/00 |
| D739,974 | S * | 9/2015 | Kelleghan | D11/201 |
| D767,250 | S * | 9/2016 | Poggi | D2/635 |
| 9,528,204 | B2 * | 12/2016 | King | D04C 1/12 |
| 9,622,552 | B2 * | 4/2017 | Pemberton | A44C 5/003 |
| 9,901,148 | B2 * | 2/2018 | Steve | A44C 5/0053 |
| 2010/0276320 | A1 * | 11/2010 | Kim | A41F 9/002 206/388 |
| 2011/0252649 | A1 * | 10/2011 | Lovitz | B26B 29/025 30/162 |
| 2013/0031935 | A1 * | 2/2013 | Kelleghan | A44C 5/00 63/1.12 |
| 2014/0026371 | A1 * | 1/2014 | Ingalls | F16G 11/00 24/115 R |
| 2014/0109615 | A1 * | 4/2014 | Millan | B26B 9/00 63/1.12 |
| 2015/0128643 | A1 * | 5/2015 | King | D04C 1/12 63/1.12 |

(Continued)

*Primary Examiner* — Justin Larson

(74) *Attorney, Agent, or Firm* — Mark Malek; Stephen Bullock; Widerman Malek, PL

(57) ABSTRACT

A wearable survival sling including a flexible medial member with a first end and a second end, a braided spine, and a braided shell enveloping the braided spine. It includes a five-in-one survival tool, a fire starter clip, a retractable blade, a steel string saw, and one of a thermal blanket and thermal tent carried by the flexible medial member. The first end and the second end are configured to be removably engaged to each other.

20 Claims, 7 Drawing Sheets

(56) References Cited

U.S. PATENT DOCUMENTS

| | | | | |
|---|---|---|---|---|
| 2015/0282571 | A1* | 10/2015 | Gendron | A44C 5/0007<br>206/372 |
| 2017/0181508 | A1* | 6/2017 | Pemberton | A44C 5/003 |
| 2017/0215529 | A1* | 8/2017 | Steve | A44C 5/0007 |
| 2017/0340094 | A1* | 11/2017 | Wells | A45F 5/00 |

* cited by examiner

WEARABLE SURVIVAL SLING

RELATED APPLICATIONS

This application claims the benefit under 35 U.S.C. § 119(e) of U.S. Provisional Patent Application Ser. No. 62/343,560 filed on May 31, 2016 and titled Wearable Survival Sling, the entire content of which is incorporated herein by reference.

FIELD OF THE INVENTION

The present invention relates to a wearable survival sling. More specifically, the present invention is directed to a sling adapted to carry items necessary for survival in the wilderness.

BACKGROUND

There exists a need in the art for a fully inclusive survival kit that is easily transportable and wearable by its user. Other survival kits are either under inclusive with the tools they provide or are overly cumbersome to carry. The structure of the present invention allows for a multitude of survival tools to easily be carried with uniformity and compactness.

This background information is provided to reveal information believed by the applicant to be of possible relevance to the present invention. No admission is necessarily intended, nor should be construed, that any of the preceding information constitutes prior art against the present invention.

SUMMARY OF THE INVENTION

With the above in mind, embodiments of the present invention are related to a wearable survival sling. In one embodiment the wearable survival sling may include a flexible medial member with a first end and a second end, a braided spine, and a braided shell enveloping the braided spine. It may also include a five-in-one survival tool, a fire starter clip, a retractable blade, a steel string saw, and one of a thermal blanket and a thermal tent carried by the flexible medial member. Furthermore, the first end and the second end may be configured to removably engage to each other.

It may also further include a shoulder strap whereby the shoulder strap may include one or more strap adjusters configured to lengthen and shorten the wearable survival sling. Furthermore, at least one of the braided spine and braided shell may be configured in one of a Cobra braid, a Solomon Bar braid, and a Portuguese Sinnet braid.

In one embodiment, the first end and the second end may removably engage to each other via a securing member whereby the first end may include one portion of the securing member and the second end may include another portion of the securing member. Furthermore, the wearable survival sling may include at least one of the five-in-one survival tool, the fire starter clip, the retractable blade, and the steel string saw braided into the flexible medial member. It may also be structured as one of a waist belt or an over-the-shoulder belt. It may include a braided shell and braided spine structured to form a medial pocket therebetween and the medial pocket may be structured to carry survival tools. The medial pocket may be structured to carry a steel string saw and one of a thermal blanket and a thermal tent.

In another embodiment the wearable survival sling may include a flexible medial member with a first end and a second end, a shoulder strap, a spine configured in one of a Cobra braid, a Solomon Bar braid, and a Portuguese Sinnet braid, a shell enveloping the spine configured in one of a Cobra braid, a Solomon Bar braid, and a Portuguese Sinnet braid, a five-in-one survival tool, a fire starter clip, a retractable blade, a steel string saw, and one of a thermal blanket and thermal tent. The steel string saw and one of a thermal blanket and thermal tent may be carried between the spine and the shell. The retractable blade may be removably attached to one of the medial member, the fire starter clip, and the five-in-one survival tool. A cord may be structured to attach the five-in-one survival tool to the shell exterior and the first end and the second end may be structured to removably engage each other.

In this embodiment the first end and the second end may removably engage to each other via a securing member. Furthermore, the securing member may be one of a side release buckle, a front release buckle, an HK Style clip, and D-Ring clips fixedly attached to the first end and the second end. The spine may be fixedly attached to the securing member proximate the first end and proximate the second end. Likewise, the shell may be attached to the spine proximate the first end and proximate the second end.

In one embodiment the wearable survival sling may include a shoulder strap threaded through a strap adjuster and configured to provide at least 3 feet of additional length to the wearable survival sling. Furthermore, the shell may include between 50 and 100 feet of nylon paracord.

One embodiment may be a wearable survival kit including in combination a medial member comprising a first end and a second end, a webbed spine, and a braided shell. It may also include at least one five-in-one survival tool, at least one fire starter clip, at least one retractable blade, at least one steel string saw, at least one thermal blanket, at least one tarp, and at least one poncho. In one embodiment the at least one steel string saw, at least one tarp, at least one poncho, and at least one thermal blanket may be carried between the webbed spine and the braided shell.

In this embodiment a first end may include a first HK Style clip and the second end may include a second HK Style clip. Furthermore, the five-in-one survival tool may include at least one of a plurality of matches, burn ointment, anti-itch ointment, antibacterial ointment, fishing hooks, fishing weights, and alcohol swabs. Some embodiments may include a flashlight removably attached to the five-in-one survival tool. This embodiment may also include the braided shell in one of a Cobra braid, a Solomon Bar braid, and a Portuguese Sinnet braid. Furthermore, the braided shell may be formed of paracord and may be structured to be detachable from the webbed spine and operable as a rope.

DETAILED DESCRIPTION OF THE INVENTION

Figure 1:
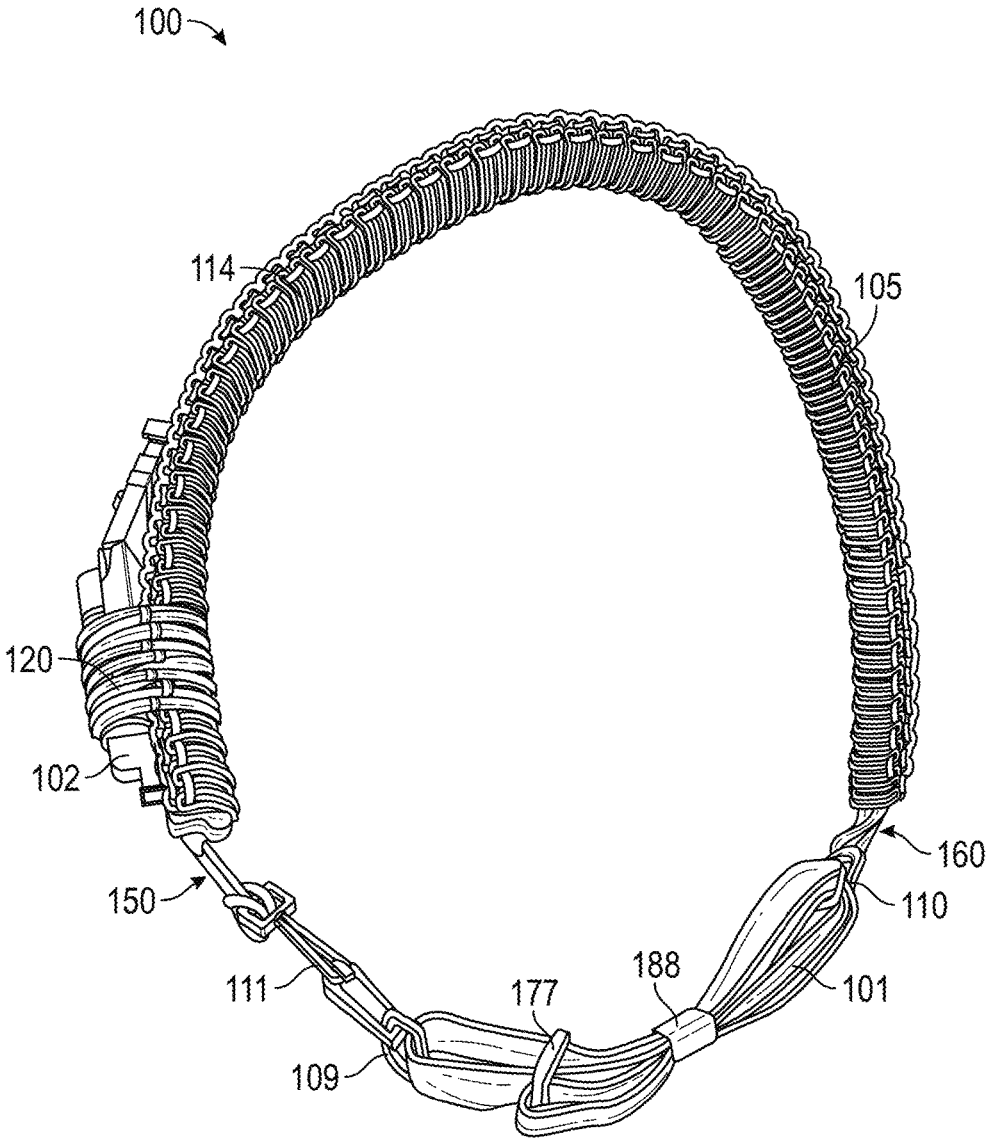
FIG. 1 is a top perspective view of wearable survival sling in a fastened configuration according to an embodiment of the present invention.
Figure 2:
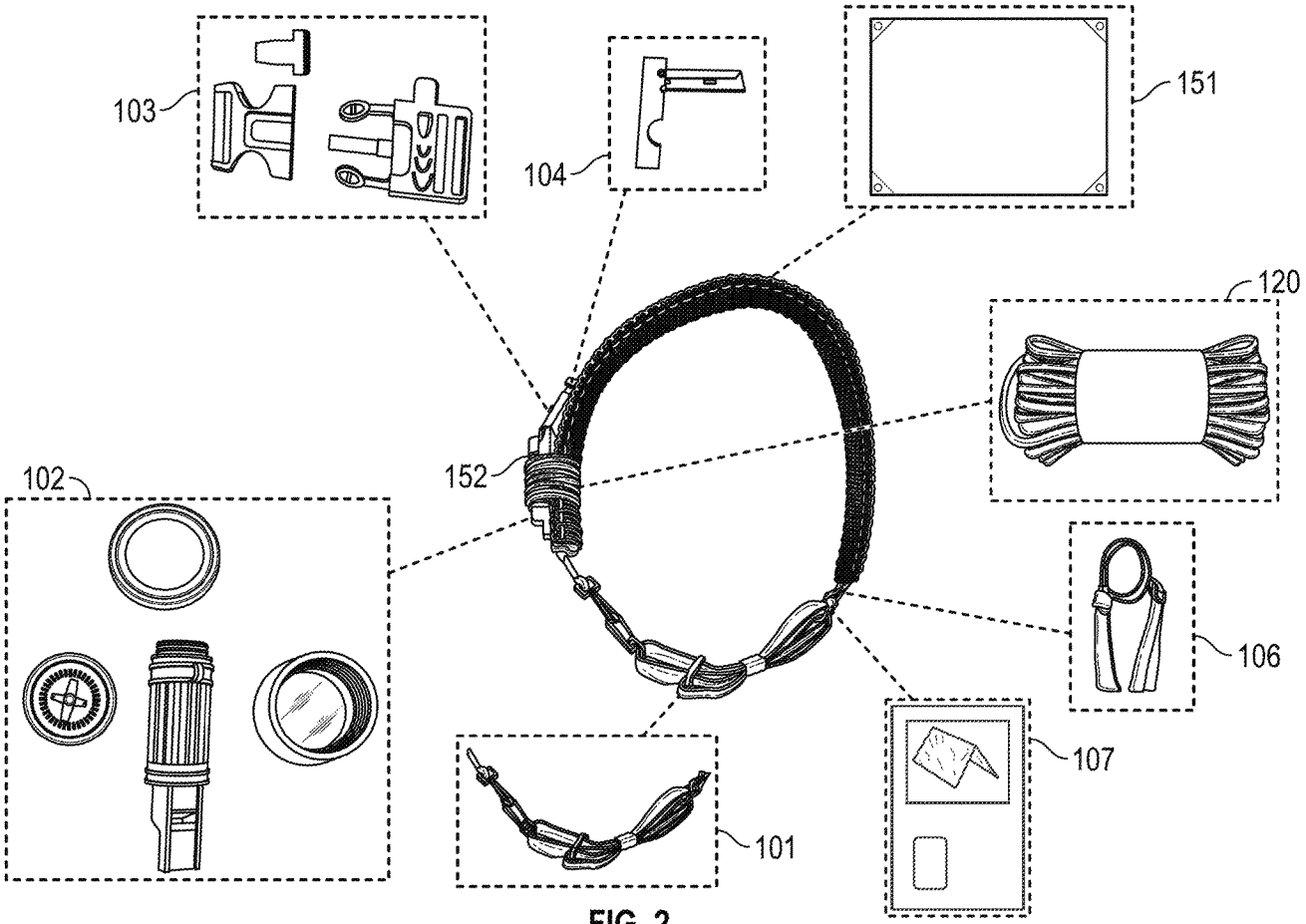
FIG. 2 is an exploded view depicting detail of the components adapted to be secured to the wearable survival sling depicted in FIG. 1.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art realize that the following descriptions of the embodiments of the present invention are illustrative and are not intended to be limiting in any way. Other embodiments of the present invention will readily suggest themselves to such skilled persons having the benefit of this disclosure. Like numbers refer to like elements throughout.

Although the following detailed description contains many specifics for the purposes of illustration, anyone of ordinary skill in the art will appreciate that many variations and alterations to the following details are within the scope of the invention. Accordingly, the following embodiments of the invention are set forth without any loss of generality to, and without imposing limitations upon, the claimed invention.

In this detailed description of the present invention, a person skilled in the art should note that directional terms, such as "above," "below," "upper," "lower," and other like terms are used for the convenience of the reader in reference to the drawings. Also, a person skilled in the art should notice this description may contain other terminology to convey position, orientation, and direction without departing from the principles of the present invention.

Furthermore, in this detailed description, a person skilled in the art should note that quantitative qualifying terms such as "generally," "substantially," "mostly," and other terms are used, in general, to mean that the referred to object, characteristic, or quality constitutes a majority of the subject of the reference. The meaning of any of these terms is dependent upon the context within which it is used, and the meaning may be expressly modified.

An embodiment of the invention, as shown and described by the various figures and accompanying text, provides a wearable survival sling 100.

Referring to FIGS. 1-10, the wearable survival sling 100 may have a nylon spine 140 covered by a utility cord shell 105. Each end of the nylon spine 140 may secure to a shoulder strap 101. The wearable survival sling 100 may be adapted to carry a five-in-one survival tool 102 and associated contents, a fire starter clip 103, a retractable blade 104, a steel string saw 106, a nylon cord 120, a thermal blanket 107, a poncho 150, a tarp 151, a flashlight 152, and self-adhesive medical wrap 153.

The wearable survival sling 100 may have a nylon spine 140. The nylon spine 140 may include an elongate nylon material however, one skilled in the art will appreciate that any durable and flexible material capable of withstanding environmental elements may be used in constructing the nylon spine 140. In some embodiments as illustrated in FIGS. 6-10, the nylon spine 140 may be nylon webbing 702, forming a webbed spine. In another embodiment, the nylon spine 140 may include an elongate nylon material in a braided configuration. By way of example, and not as a limitation, the braided configuration may be a cobra, Solomon Bar, or Portuguese Sinnet braid. Those skilled in the art will appreciate that other braided configurations may be utilized. The nylon spine 140 may be adapted to carry a securing member at each of a first end 170 and an opposing second end 160 of the nylon spine 140. The securing member may be any item adapted to capture or carry another securing member.

The nylon spine 140 may include between fifty and one hundred feet of an elongate cord made from nylon or any other sturdy and flexible material. The nylon spine 140 may form the interior medial portion of at least a portion of the wearable survival sling 100. The nylon spine 140 may provide the core of the wearable survival sling 100 and allow the other components to be attached and assembled thereto as a single wearable unit. The braided interweaving of the nylon spine 140 may knurl its exterior, which may facilitate the utility cord shell 105 gripping and encasing its exterior. The nylon spine 140 may be secured at one end to a D-ring dip 111 and at an opposing end to a shoulder strap ring 110. By way of non-limiting example, the nylon spine 140 may be 3 feet in length and may be 1 inch in width.

The nylon spine 140 may be secured to the D-ring clip 111 at one end by making a loop through the D-ring portion of the D-ring dip 111 with the nylon cord that will ultimately comprise the nylon spine 140. The nylon spine 140 may be secured to the shoulder strap ring 110 at an opposing end by using the same cord and making a loop through the shoulder strap ring 110. The two ends may be secured by tying what is known in the art as an overhand knot. The nylon spine 140 may be formed by starting at the end proximal to the shoulder strap ring 110 loop and tying a half knot around the loop then tightening the nylon cord to begin creating the nylon spine 140. This process may be repeated until the desired length of the nylon spine 140 has been achieved and an end of the nylon spine 140 may be secured to the D-ring dip 111. Once the desired length has been achieved, both ends of the braided nylon cord may be cut and singed to secure them in place.

A first end 170 of the nylon spine 140 may be adapted to carry a D-ring dip 111. The D-ring clip 111 may be configured so that a first portion is formed as a clasp and a second portion is formed as a ring. In one embodiment, the ring may be a "D" shaped ring. The clasp portion may be integral with the ring portion. The clasp portion may be adapted to capture a securing member directly attached to the shoulder strap 101. Securing the D-ring clip 111 to the shoulder strap dip 109 directly attached to the shoulder strap 101 may place the wearable survival sling 100 in a fastened configuration.

A second end 160 of the nylon spine 140 may be adapted to carry a shoulder strap ring 110. The shoulder strap ring 110 may be a D-ring. A portion of the nylon spine 140 may be threaded through a medial aperture of the shoulder strap ring 110. The shoulder strap ring 110 may also be secured to a shoulder strap 101. An end of the shoulder strap 101 may be threaded through a medial aperture of the shoulder strap ring 110. In some embodiments, the nylon spine 140 may be attached at opposing ends to an HK style clip 601, a side release buckle or a front release buckle instead of D-ring clips 111. In another embodiment the nylon spine 140 may be attached at one end to a D-ring clip 111 with additional nylon webbing extending therefrom that may then be attached to an HK style clip 601. In this embodiment the nylon spine 140 may be attached at another end directly to an HK style dip 601. Furthermore, the HK style dip 601 and/or buckles may be attachable to themselves thereby configuring the wearable survival sling 100 in a closed orientation.

The shoulder strap 101 may be positioned between the first end 170 and the second end 160 of the nylon spine 140. The shoulder strap 101 may be an elongate member constructed from a material well known to those skilled in the art. By way of non-limiting example, the shoulder strap 101 may be made of nylon, however, one skilled in the art will appreciate that any durable and flexible material capable of withstanding environmental elements may be used in its construction. The shoulder strap 101 may include one or more strap adjusters 177 capable of lengthening or shortening the shoulder strap 101 as desired. The strap adjuster 177 may be made of any durable material including, but not limited to, metal or plastic. The strap adjuster 177 may be located between the D-ring clip 111 and the shoulder strap ring 110 and may be configured in a manner so as to allow slack from the shoulder strap 101 to be threaded and looped therethrough.

The shoulder strap 101 may be threaded through the strap adjuster 177 three times and may provide up to an additional three feet in length to the wearable survival sling 100 when extended. However, the configuration of the strap adjuster 177 may allow the shoulder strap 101 and, as a result, the wearable survival sling 100 to be lengthened or shortened as needed or desired by a user. To lengthen the shoulder strap 101 a user may lift one of the strap adjusters 177 and pull out slack from the strap. Once a desired length has been reached, the strap adjuster 177 may be released and thereby secured to the shoulder strap 101 once again. In order to keep the shoulder strap 101 in a tight configuration, the shoulder strap 101 may include an elastic placeholder 188 that wraps around the unused excess portion of the shoulder strap 101.

A utility cord shell 105 may envelop the nylon spine 140. The utility cord shell 105 may include a nylon or any other sturdy elongate material, which are well known to those skilled in the art. By way of non-limiting example, the utility cord shell 105 may be formed from between fifty and one hundred feet of heavy duty nylon paracord. One skilled in the art will appreciate that any durable and flexible material capable of withstanding environmental elements may be used. The utility cord shell 105 may be braided in a manner so as to facilitate gripping the nylon spine 140 by frictionally engaging the braided ridges thereof. The braid may be formed as a cobra, Solomon Bar, or Portuguese Sinnet braid. The utility cord shell 105 may be tethered to the nylon spine 140 at a first end 170 proximate the D-ring clip 111. The utility cord shell 105 may be located along a substantial portion of the length of the nylon spine 140. The utility cord shell 105 may cover the entirety of the nylon spine 140 but leave both the first end 170 and second end 160 of the nylon spine 140 exposed and uncovered. The utility cord shell 105 may tether to a second end 160 of the nylon spine 140 proximate the shoulder strap ring 110.

To form the utility cord shell 105, a user may tie an overhand knot on top of the nylon spine 140 at the end proximate the D-ring dip 111. An overhand knot may also be tied over the thermal blanket 107 and steel string saw 108 thereby securing them between the nylon spine 140 and the utility cord shell 105. Then, a half knot may be tied around the nylon spine and tightened. A series of half knots may be tied around the nylon spine 140 along the length thereof until the nylon spine 140 is enveloped by the utility cord shell 105 and secured at the end proximate the shoulder strap ring 110. The ends of the braided nylon rope may then be singed to secure them in place. The process may be repeated in the opposite direction starting with the end proximate the shoulder strap ring 110 and finishing at the D-ring clip 111 in order to add another layer of utility cord shell 105 to the wearable survival sling 100.

The utility cord shell 105, along with the nylon spine 140, may form a flexible medial member 114. The utility cord shell 105 may be removable from the nylon spine 140 and, in an unbraided configuration, may provide a length necessary to be effective as a survival tool. Although different embodiments may vary as to the amount of nylon cord used for the shell, by way of non-limiting example it is contemplated that anywhere from 50 to 150 feet may be used. Therefore, the utility cord shell 105 may be either untethered from the nylon spine 140 or the retractable blade may be used to cut away a portion of the utility cord shell 105 from nylon spine 140 in order to utilize the entire utility cord shell 105, or a portion thereof, independently as a rope. Likewise, the nylon spine 140 may either be untethered, or a portion cut away using the retractable blade 104 from the wearable survival sling 100 in order to utilize the entire nylon spine 140, or a portion thereof, independently as a rope.

The configuration of the utility cord shell 105 braided overtop of the nylon spine 140 may create a medial pocket between the utility cord shell 105 and the nylon spine 140 for survival tools to be easily stored and transported within. At a second end of the nylon spine 140 and flexible medial member 114 there may be a steel string saw 106 stored within the medial pocket.

The steel string saw 106 may be a commercially available product and may be obtained from a variety of sources well known to those skilled in the art. The steel string saw 106 may include a medial member comprised of a steel chain that may include teeth capable of sawing when wrapped around an item such as a tree. However, any material capable of providing a chain comprised of teeth is contemplated herein. The steel string saw 106 may include nylon straps at a first and an opposing second end of the medial member configured to allow a user to grasp and use the steel string saw 106 when detached from the wearable survival sling 100. In some embodiments the steel string saw 106 may include a gripping ring 801 at each end of its medial member. The gripping rings 801 may be completely enveloped within the medial pocket or may be configured to protrude through the utility cord shell 105 for easy access. In some embodiments the gripping rings 801 may be detachable from the medial member of the steel string saw 106 and the gripping rings 801 may be interwoven with the utility cord shell 105 for easy access. However, any material capable of attaching to the medial member and providing a grip for a user is contemplated herein. When the steel string saw 106 is transported by the wearable survival sling 100, it may be carried by the flexible medial member 114 within the medial pocket. The steel string saw 106 may be detached, or removed from within the medial pocket of the wearable survival sling 100 for independent use.

Figure 9:
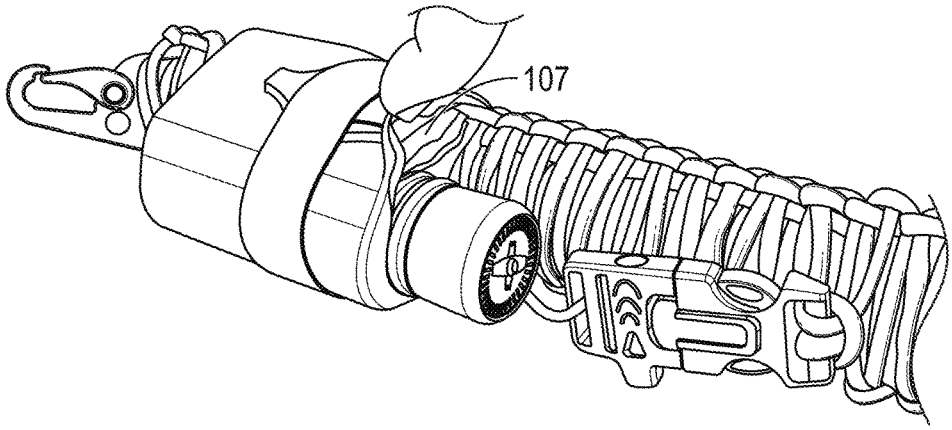
FIG. 9 is a perspective view of one end of the wearable survival sling depicted in FIG. 6.
Figure 10:
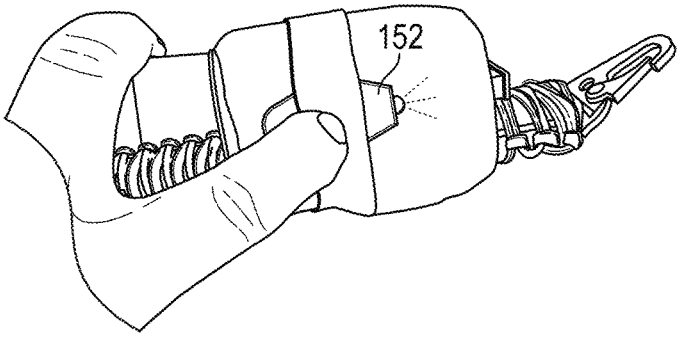
FIG. 10 is a perspective view of one end of the wearable survival sling containing a flashlight in accordance with the embodiment depicted in FIG. 6.

Also stored within the medial pocket may be a thermal blanket 107. The thermal blanket 107 may be a commercially available product and may be obtained from a variety of sources well known to those skilled in the art. By way of non-limiting example, it may be comprised of heat-reflective thin sheeting comprised of plastic and/or a polyester film such as Biaxially-oriented polyethylene terephthalate (Bo-PET). In some embodiments the thermal blanket 107 may be enabled as a reflective tent when detached from the wearable survival sling 100. Persons skilled in the art will appreciate that the use of the heat-reflective thin plastic sheeting product will depend on the particular model used. In other embodiments, as illustrated in FIG. 9, the thermal blanket 107 may be folded and secured to the exterior of the wearable survival sling 100 adjacent the five-in-one survival tool via ranger band 802.

Figure 7:
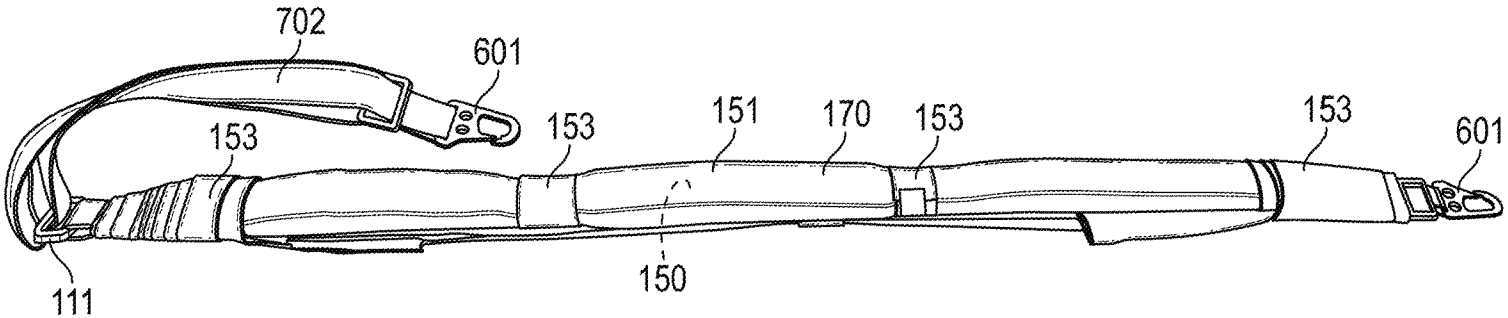
FIG. 7 is a top perspective view of contents located within the wearable survival sling depicted in FIG. 6.
Figure 8:
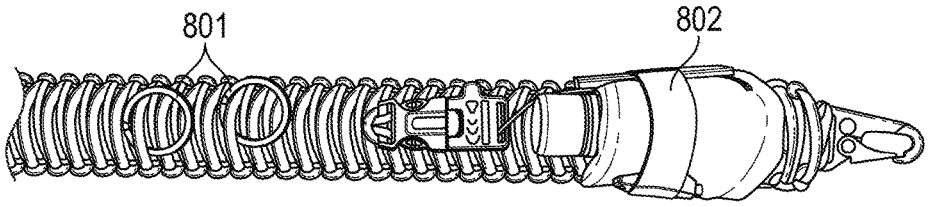
FIG. 8 is a sectional view of the wearable survival sling depicted in FIG. 6.

In some embodiments a reflective tent may be carried by the medial pocket in place of or in addition to a thermal blanket 107. The thermal blanket 107 or reflective tent may be detached or removed from the medial pocket for independent use. Likewise, a poncho 150 and tarp 151 may be carried by the medial pocket. In some embodiments the tarp 151 may be made of 9 feet by 12 feet of foldable plastic compressed into a size able to fit within the medial pocket. The thermal blanket 107 and/or thermal tent, and poncho 150 may also be foldable or flexible enough to be compressed to a size able to fit within the medial pocket. In some embodiments, as illustrated in FIG. 7, the poncho 150 may be wrapped around the nylon spine 140 and the tarp 151 may be wrapped around the poncho 150 within the medial pocket.

A five-in-one survival tool 102 may be secured to the flexible medial member 114 at or near the first end 170. The five-in-one survival tool 102 may be a commercially available product obtained from a variety of sources well known to those skilled in the art. By way of non-limiting example, the five-in-one survival tool 102 may be made of plastic, however, one skilled in the art will appreciate that any durable material capable of withstanding environmental elements may be used in its construction, including metal. The five-in-one survival tool 102 may include a whistle, a compass, a storage compartment, a signaling mirror, and a flint fire starter located on the outside of its casing. The five-in-one survival tool 102 may include a plurality of matches, burn ointment, anti-itch ointment, antibacterial ointment, fishing hooks, fishing weights, and alcohol swabs within its storage compartment. By way of example, the storage compartment may be sized to fit 6 matches, a container of burn ointment, a container of anti-itch ointment, a container of antibacterial ointment, four (4) fishing hooks of two different sizes, two (2) fishing weights, and two (2) alcohol swabs. The five-in-one survival tool 102 may easily be detached from the wearable survival sling 100 for independent use. In the present embodiment the five-in-one survival tool 102 may be tied to the outside of the flexible medial member 114 using ten feet of a second nylon cord 120. The second nylon cord 120 may be wrapped around the five-in-one survival tool 102 and the flexible medial member 114 thereby securing the five-in-one survival tool 102 to the flexible medial member 114. In other embodiments, the five-in-one survival tool 102 may be tied to the wearable survival sling 100 using an extension of the utility cord shell 105. The five-in-one survival tool 102 may be braided into the flexible medial member 114.

In yet another embodiment, instead of the five-in-one survival tool 102 secured to the flexible medial member 114 with nylon cord 120, the five-in-one survival tool 102 may be attached to the exterior of the flexible medial member 114 by way of field grade rubber bands. These rubber bands are known in the art as ranger bands 802. A first ranger band 802 may be used to secure the five-in-one survival tool 102 to the exterior of the utility cord shell 105. A length of Self-adhesive medical wrap 153 may be wrapped around the five-in-one survival tool 102 and the first ranger band 802. A flashlight 152 may be fitted overtop the Self-adhesive medical wrap 153 and secured to the survival sling 100 by a second ranger band 802. In some embodiments the thermal blanket 107 may be stored adjacent the five-in-one survival tool 102 and secured to the exterior of the utility cord shell 105 by the first and/or second ranger band 802.

The fire starter clip 103 may be a commercially available product and may be obtained from a variety of sources well known to those skilled in the art. The fire starter clip 103 may contain an aperture on a first end thereof allowing it to easily be tethered or attached to the wearable survival sling 100. The fire starter clip 103 may have a portion of the utility cord shell 105 braided through the aperture, thereby securing it to the wearable survival sling 100. However, persons skilled in the art will appreciate that the fire starter clip 103 may be detachably engaged with the wearable survival sling 100 by any number of means including utilizing a clip with a first end attached to the fire starter clip 103 and a second end of the clip attached to the wearable survival sling 100. The fire starter clip 103 may also be stored within the medial pocket of the flexible medial member 114.

The retractable blade 104 may be a commercially available product and may be obtained from a variety of sources well known to those skilled in the art. The retractable blade 104 may contain a first end aperture allowing it to easily be tethered or attached to the wearable survival sling 100. In one embodiment, the retractable blade 104 may be secured to the fire starter clip 103 by a beaded chain looped through the fire starter clip aperture and an aperture located within the retractable blade 104 casing. However, other means of attachment are contemplated including having the retractable blade 104 braided into the flexible medial member 114 or storing it within the medial pocket of the flexible medial member 114. Yet other embodiments, may include the retractable blade 104 secured to the five-in-one survival tool 102 by the nylon cord 120 or a ranger band 802. Persons skilled in the art will appreciate that the retractable blade 104 may be detachably engaged from the wearable survival sling 100 by any number of means including a clip with a first end attached to the retractable blade 104 and a second end of the clip attached to the wearable survival sling 100.

In some embodiments, the steel string saw 106, the tarp 151, the poncho 150, and thermal blanket 107 may be stored between the nylon spine 140 and the utility cord shell 105 within the medial pocket. These items may be secured to the nylon spine 140 within the medial pocket by Self-adhesive medical wrap 153 that is wrapped around the items and the nylon spine 140 within the medial pocket. The utility cord shell 105 may then be a braid enveloping the nylon spine 140 and the tools wrapped in the Self-adhesive medical wrap 153. In yet other embodiments, the steel string saw 106, the tarp 151, and the poncho 150 may be stored within the medial pocket while the thermal blanket 107 is compactly secured next to the five-in-one survival tool 102 and flashlight 152 via a first or second ranger band 802.

Figure 3:
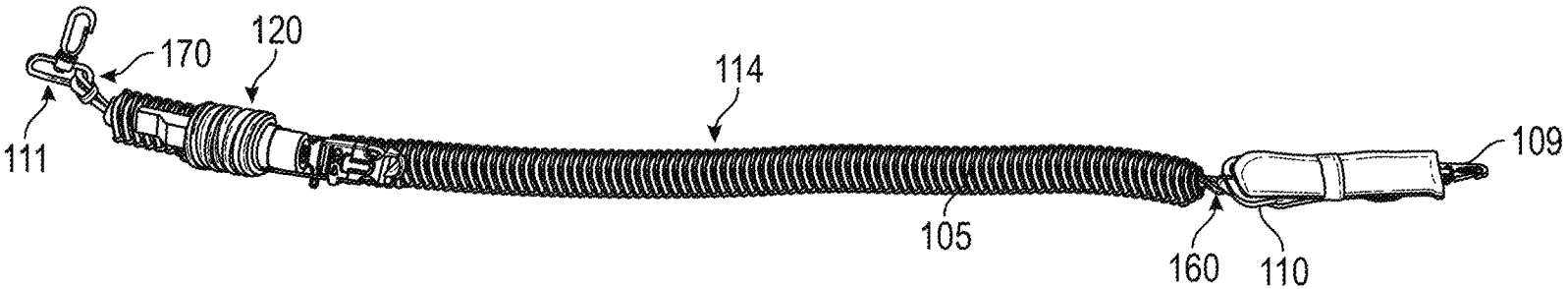
FIG. 3 is a top perspective view of the wearable survival sling depicted in FIG. 1 in an unfastened configuration.
Figure 4:
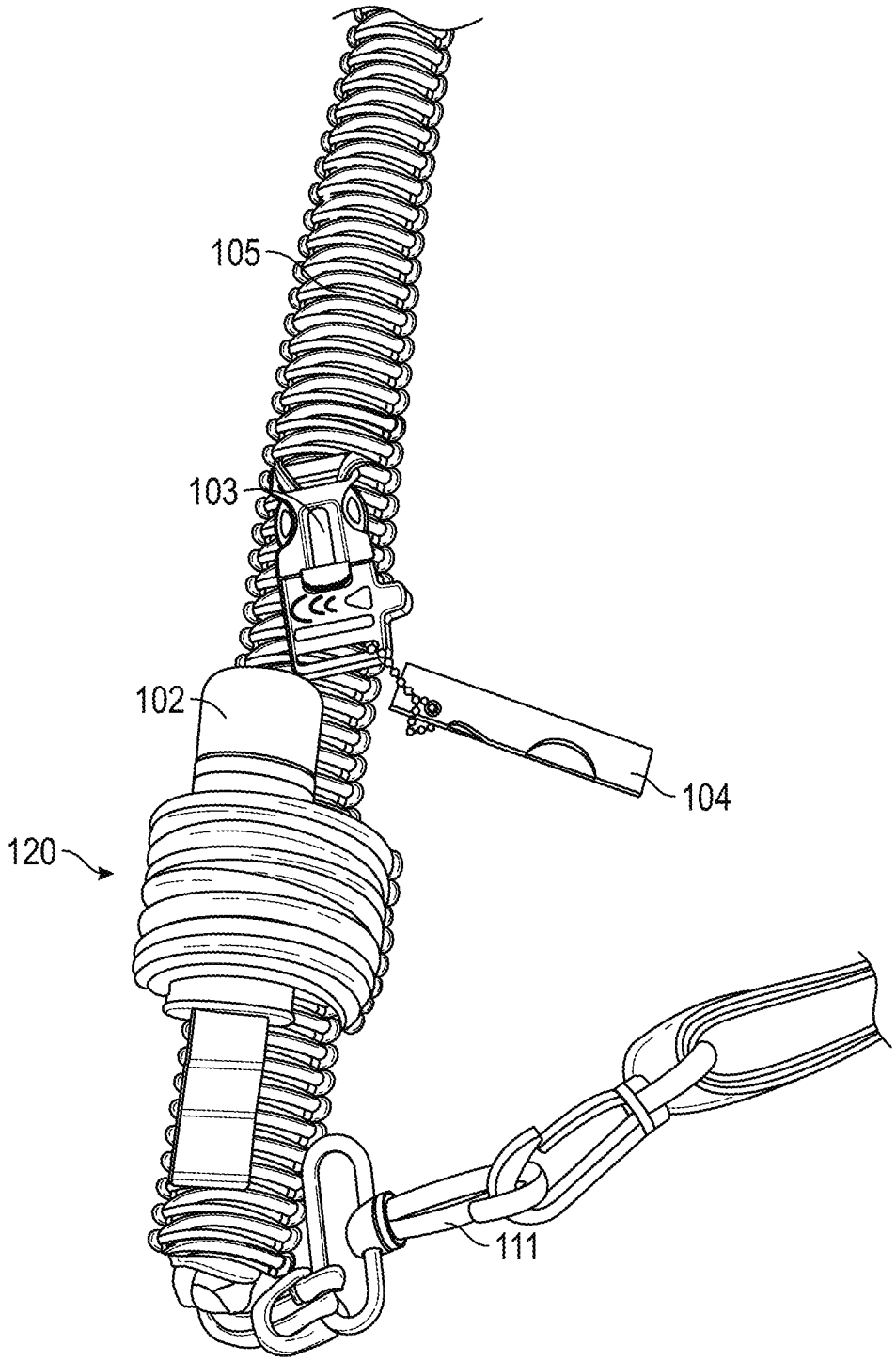
FIG. 4 is a partial perspective view of an end of a nylon spine of the wearable survival sling as depicted in FIG. 1.
Figure 5:
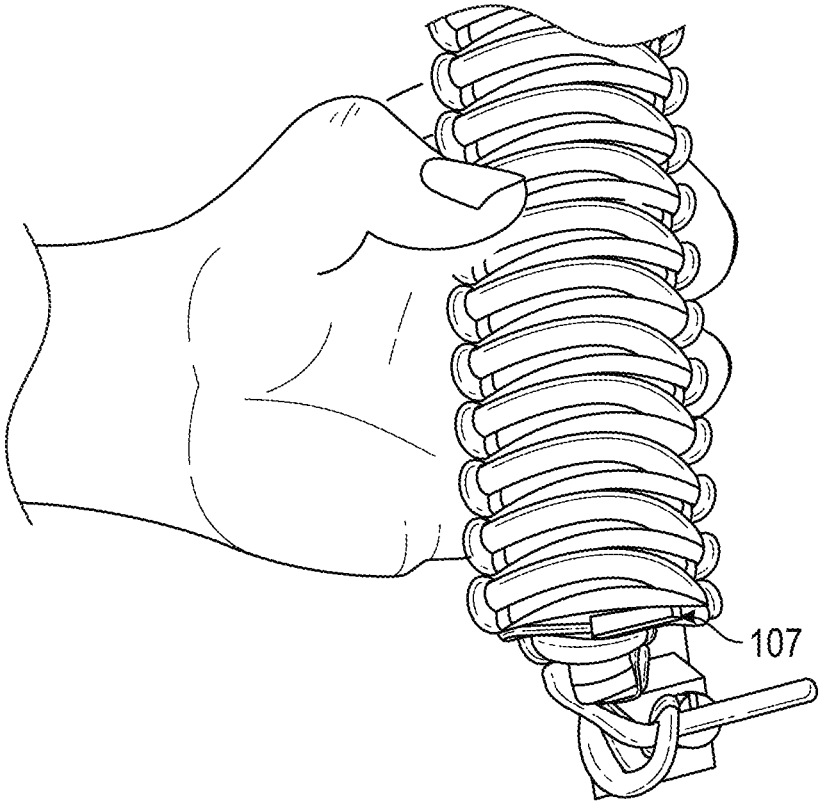
FIG. 5 is a detail partial perspective view of a thermal blanket and a steel string saw of the wearable survival sling as depicted in FIG. 1.
Figure 6:
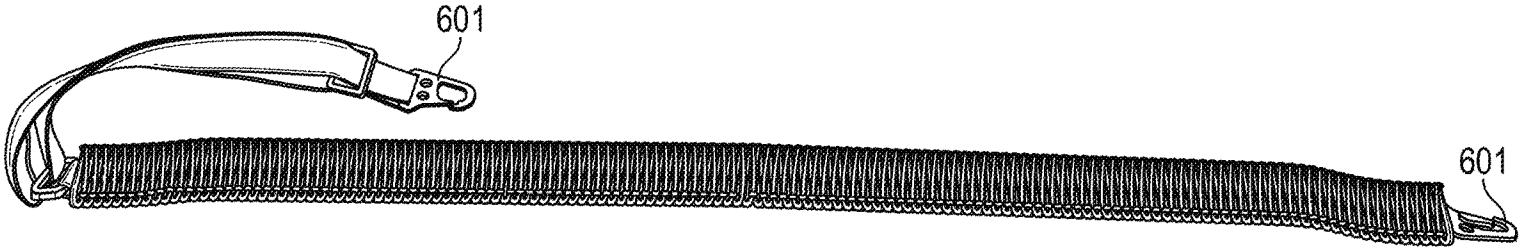
FIG. 6 is a top perspective view of another embodiment of the wearable survival sling depicted in an unfastened configuration.

The wearable survival sling 100 may be used as a transportation apparatus for survival tools sometimes needed in outdoor excursions. As shown by FIG. 1, the D-ring clip 111 and the shoulder strap clip 109 may be clasped together into a closed loop. Such a configuration may be referred to as a fastened configuration and may facilitate transporting the wearable survival sling 100 over a user's shoulder or around a user's waist. As shown in FIG. 3, the D-ring clip 111 and the shoulder strap clip 109 may be unclasped thereby configuring the wearable survival sling 100 into an elongated member. Such a configuration may be referred to as an unfastened configuration.

The flexibility of the flexible medial member 114 and the configuration of the D-ring clip 111 and shoulder strap clip 109 may allow for a user to easily carry the wearable survival sling 100 over a user's shoulder. When in the fastened configuration, the wearable survival sling 100 may form a closed loop allowing a user to slide the apparatus over an arm and rest on an opposing shoulder while crossing the user's chest. However, in some embodiments, a user may wear the apparatus with a top portion resting on their shoulder, while the bottom portion rests underneath the same shoulder and arm. Although the wearable survival sling 100 may contain a shoulder strap 101 for ease of use, which may rest on a user's shoulder during transport, any portion of the wearable survival sling 100 may be used to rest on a user's shoulder during transport. For example, the flexible medial member 114 may be used as an alternative shoulder strap for transporting the wearable survival sling 100.

As shown in FIG. 3, the wearable survival sling 100 may be detached from itself in the unfastened configuration and form what may be a linearly shaped apparatus. This may be useful for a user wishing to place the wearable survival sling 100 on the user's shoulder then fasten the apparatus to itself. It may also be useful for a user wishing to place the wearable survival sling 100 around the user's waist then fasten the apparatus in a belt-like fashion.

In one embodiment, the wearable survival sling 100 may be sized to fit around a user's waist. In this embodiment, a user may ensure that the wearable survival sling 100 is in the unfastened configuration as depicted in FIG. 3. The wearable survival sling 100 may then be fastened about the user's waist. The user may then clip the wearable survival sling 100 in the fastened configuration enabling the user to transport the apparatus without further assistance needed by the user. In this embodiment, a user may be able to transport the items in the wearable survival sling 100 without utilizing one or both hands. Furthermore, this embodiment may allow a user to easily access the items within the wearable survival sling 100 while simultaneously walking or performing another physical activity.

Different embodiments of the wearable survival sling 100 may determine how it is used. In one embodiment, each of the survival tools is attached to the flexible medial member 114 by way of clips. In this embodiment, a user wishing to make use of one of the tools would simply unclip the tool needed. In another embodiment all or some of the survival tools may be carried within the medial pocket of the flexible medial member 114. In this embodiment, a user wishing to make use of one of the tools would either remove the tool needed from the medial pocket, or use the retractable blade 104 to cut away the utility cord shell 105 to get to the tool.

Some of the illustrative aspects of the present invention may be advantageous in solving the problems herein described and other problems not discussed which are discoverable by a skilled artisan.

While the above description contains much specificity, these should not be construed as limitations on the scope of any embodiment, but as exemplifications of the presented embodiments thereof. Many other ramifications and variations are possible within the teachings of the various embodiments. While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

Thus the scope of the invention should be determined by the appended claims and their legal equivalents, and not by the examples given.

That which is claimed is:

1. A wearable survival sling comprising:

a flexible medial member comprising a first end and a second end;

a braided spine;

a braided shell enveloping the braided spine; and a five-in-one survival tool, a fire starter dip, a retractable blade, a steel string saw, and one of a thermal blanket and a thermal tent carried by the flexible medial member;

wherein the first end and the second end are configured to removably engage to each other.

2. The wearable survival sling according to claim 1 further comprising a shoulder strap; wherein the shoulder strap comprises one or more strap adjusters configured to lengthen and shorten the wearable survival sling.

3. The wearable survival sling according to claim 1 wherein at least one of the braided spine and braided shell are configured in one of a Cobra braid, a Solomon Bar braid, and a Portuguese Sinnet braid.

4. The wearable survival sling according to claim 1 further comprising a securing member; wherein the securing member includes a first portion carried by the first end and a second portion carried by the second end; wherein the first portion of the securing member and the second portion of the securing member are removably connectable to one another; and wherein connecting the first portion of the securing member to the second portion of the securing member causes the first end and the second end to be removably engageable.

5. The wearable survival sling according to claim 1 wherein at least one of the five-in-one survival tool, the fire starter dip, the retractable blade, and the steel string saw are braided into the flexible medial member.

6. The wearable survival sling according to claim 1 wherein the wearable survival sling is configured as one of a waist belt and an over-the-shoulder belt.

7. The wearable survival sling according to claim 1 wherein the braided shell and the braided spine are configured to form a medial pocket therebetween; and wherein the medial pocket is configured to carry survival tools.

8. The wearable survival sling according to claim 7 wherein the medial pocket is configured to carry a steel string saw and one of a thermal blanket and a thermal tent.

9. A wearable survival sling comprising:

a flexible medial member comprising a first end and a second end;

a shoulder strap positioned between the first end and the second end;

a spine configured in one of a Cobra braid, a Solomon Bar braid, and a Portuguese Sinnet braid; and a shell enveloping the spine, the shell configured in one of a Cobra braid, a Solomon Bar braid, and a Portuguese Sinnet braid;

a five-in-one survival tool, a fire starter clip, a retractable blade, a steel string saw, and one of a thermal blanket and thermal tent;

wherein the steel string saw and one of a thermal blanket and thermal tent are carried between the spine and the shell;

wherein the retractable blade is removably attached to one of the medial member, the fire starter dip, and the five-in-one survival tool;

wherein a cord is configured to attach the five-in-one survival tool to the shell exterior; and wherein the first end and the second end are configured to removably engage each other.

10. The wearable survival sling according to claim 9 further comprising a securing member; wherein the securing member includes a first portion carried by the first end and a second portion carried by the second end; wherein the first portion of the securing member and the second portion of the securing member are removably connectable to one another; and wherein connecting the first portion of the securing member to the second portion of the securing member causes the first end and the second end to be removably engageable.

11. The wearable survival sling according to claim 10 wherein the spine is fixedly attached to the securing member proximate the first end and proximate the second end; and wherein the shell is attached to the spine proximate the first end and proximate the second end.

12. The wearable survival sling according to claim 9 wherein the shoulder strap is threaded through a strap adjuster and configured to provide at least 3 feet of additional length to the wearable survival sling.

13. The wearable survival sling according to claim 9 wherein the shell is comprised of between 50 and 100 feet of nylon paracord.

14. A wearable survival kit comprising, in combination:

a medial member comprising a first end and a second end, a webbed spine, and a braided shell;

at least one five-in-one survival tool;

at least one fire starter dip;

at least one retractable blade;

at least one steel string saw;

at least one thermal blanket;

at least one tarp; and at least one poncho;

wherein the at least one steel string saw, at least one tarp, at least one poncho, and at least one thermal blanket are carried between the webbed spine and the braided shell.

15. The wearable survival kit according to claim 14 wherein the first end comprises a first HK Style clip and the second end comprises a second HK Style dip.

16. The wearable survival kit according to claim 14 wherein the five-in-one survival tool comprises at least one of a plurality of matches, burn ointment, anti-itch ointment, antibacterial ointment, fishing hooks, fishing weights, and alcohol swabs.

17. The wearable survival kit according to claim 14 wherein a flashlight is removably attached to the five-in-one survival tool.

18. The wearable survival kit according to claim 14 wherein the braided shell is in one of a Cobra braid, a Solomon Bar braid, and a Portuguese Sinnet braid.

19. The wearable survival kit according to claim 14 wherein the braided shell is formed of paracord.

20. The wearable survival kit according to claim 14 wherein the braided shell is configured to be detachable from the webbed spine and operable as a rope.

* * * * *